US008759653B2

(12) United States Patent
Berndt

(10) Patent No.: US 8,759,653 B2
(45) Date of Patent: Jun. 24, 2014

(54) DRUM LUG

(71) Applicant: Lawrence Berndt, Cornish, NH (US)

(72) Inventor: Lawrence Berndt, Cornish, NH (US)

( * ) Notice: Subject to any disclaimer, the term of this patent is extended or adjusted under 35 U.S.C. 154(b) by 0 days.

(21) Appl. No.: 13/742,951

(22) Filed: Jan. 16, 2013

(65) Prior Publication Data

US 2013/0180381 A1 Jul. 18, 2013

Related U.S. Application Data

(60) Provisional application No. 61/586,946, filed on Jan. 16, 2012.

(51) Int. Cl.
*G10D 13/02* (2006.01)

(52) U.S. Cl.
USPC ..... 84/413

(58) Field of Classification Search
USPC ..... 84/411 R, 421
See application file for complete search history.

(56) References Cited

U.S. PATENT DOCUMENTS

2004/0134333 A1* 7/2004 May ..... 84/413
2008/0173158 A1* 7/2008 Lee ..... 84/421

* cited by examiner

*Primary Examiner* — Kimberly Lockett
(74) *Attorney, Agent, or Firm* — Nields, Lemack & Frame, LLC

(57) ABSTRACT

A drum lug assembly for use with a drum, in which the drum lug assembly is attached to the drum shell without the need for a fastener than passes through the drum shell. In some embodiments, an undercut dovetail joint is used to allow the drum lug assembly to be slid into a groove in a wooden drum shell. In other embodiments, a slot is formed in the drum shell, and the drum lug is inserted and rotated to hold it in place.

8 Claims, 7 Drawing Sheets

DRUM LUG

This application claims priority of U.S. Provisional Application Ser. No. 61/586,946, filed Jan. 16, 2012, the disclosure of which is incorporated herein by reference in its entirety.

BACKGROUND OF THE INVENTION

A conventional musical drum typically has a body, in the shape of a hollow cylinder, where one or both ends of the body are covered by a drum head. The drum head typically includes a drum skin, which covers the open end of the body. The drum skin is held in place and under tension by a rim, which circumscribes the outer edge of the hollow cylinder.

The rim is secured to the drum body by a set of tension rods that pass through openings in the rim and are received by brackets mounted around the perimeter of the drum body.

FIG. 1 shows an example of a representative drum, having a drum body 10, with drum heads on each end of the drum body 10. The drum head includes a rim 20, which includes a plurality of openings 21. The rim 20 may be metal or wood, as desired. Also shown is a plurality of brackets 30 mounted around the periphery of the drum body 10, also known as the shell. Tension rods 40 pass through the openings 21 in the rim 20 and through the brackets 30. These tension rods 40 serve to hold the rims 20 tightly to the ends of the drum body 10. The brackets 30 are attached to the shell using bolts that pass through the shell.

FIG. 2 shows a second drum, having a drum body 10, a drum head on the top side, and rims 20 at each end. Tension rods 40 are shown passing through the openings 21 in the rims 20 and into the brackets 30 mounted to the drum shell. The brackets 30 are attached to the shell using bolts that pass through the shell.

FIG. 3 shows an interior view of the drum of FIG. 2. Inside the drum body 10 are bolts 50 which pass from the interior of the shell to the exterior and attach to the brackets 30. Washers 51 may be used to protect the shell and provide a better seal.

The brackets, bolts and washers together may be termed a drum lug, or drum lug assembly. The drum lugs serve to maintain the shape of the drum shell. The use of bolts also serves to stiffen the shell, complicates the assembly process, and may be a source of air leaks.

Therefore, it would be beneficial if there were a drum lug that was easier to use, and did not require bolts which pass through the drum shell.

SUMMARY OF THE INVENTION

A drum lug assembly for use with a drum, in which the drum lug assembly is attached to the drum shell without the need for a fastener than passes through the drum shell. In some embodiments, an undercut dovetail joint is used to allow the drum lug assembly to be slid into a groove in a wooden drum shell. In other embodiments, a slot is formed in the drum shell, and the drum lug is inserted and rotated to hold it in place.

DETAILED DESCRIPTION OF THE INVENTION

Figure 4A:
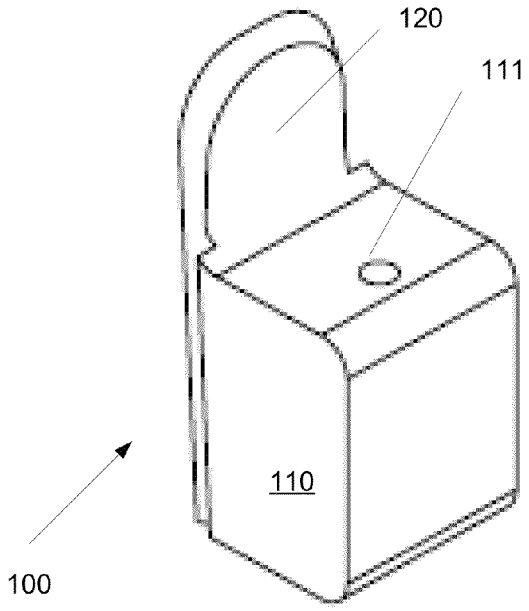
FIG. 4A shows a perspective view of the drum lug of the present invention.
Figure 4B:
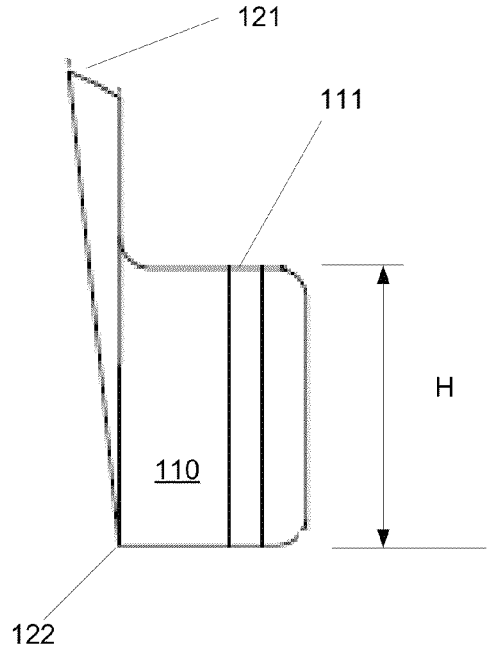
FIG. 4B shows a side view of the drum lug of FIG. 4A.

FIG. 4A shows a perspective view of a first embodiment of a new drum lug 100. The new drum lug 100 may be constructed of any suitable material, such as wood, plastic, brass or other metals. The lug 100 includes an outwardly extending lug body 110. The lug body 110 has a conduit extending through the length of the lug body 110. In FIG. 4B, the conduit 111 is shown as passing vertically through the lug body 110. However, in other embodiments, the conduit may pass horizontally through the lug body 110. The conduit may be threaded if desired, but does not need to be threaded.

Figure 4C:
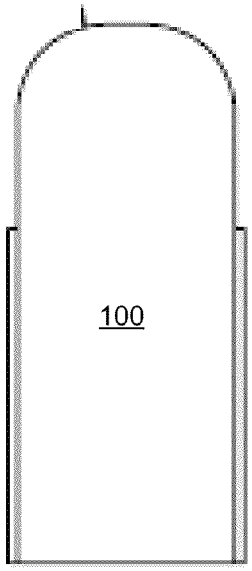
FIG. 4C shows a rear view of the drum lug of FIG. 4A.
Figure 4D:
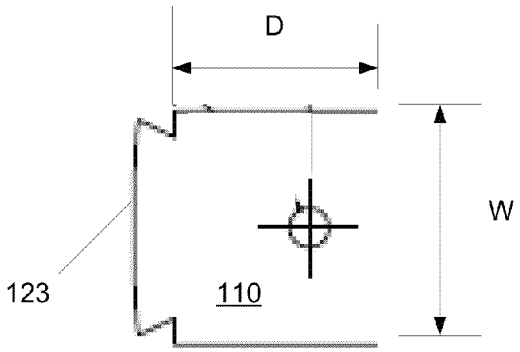
FIG. 4D shows a top view of the drum lug of FIG. 4A.

FIG. 4C shows the back view of the lug 100. FIG. 4D shows a top view of the lug 100. In one particular embodiment, the lug body 110 has a width (W) and depth (D) of about 0.812 inches, although other dimensions are possible. In one embodiment, the central axis of the conduit is approximately 0.315 inches from the outer edge of the lug body 110. The height (H) of the lug body 110 may be varied.

The drum lug 100 also includes a lug attachment member 120, which attaches to the drum shell, as described herein. The lug attachment member 120 and the lug body 110 may be of unitary construction, or may be separate parts that are affixed to one other.

The lug attachment member 120 is intended to mate with the drum shell. To do this, it is designed to slide into a slot or groove in the drum shell. In one embodiment, as best seen in FIG. 4A and FIG. 4B, the lug attachment member 120 is tapered, whereby one end is thicker than the opposite end. In these figures, the upper end 121 of the lug attachment member 120 is shown as being thicker than the lower end 122 (which may correspond to the lower edge of the lug body 110). In some embodiments, the upper end 121 may be 0.187 inches thicker than the lower edge.

In addition, the back side 123 of the lug attachment member 120 may be larger than its front side (where it is affixed to the back side of the lug body 110), as shown in FIG. 4D. In other words, the sides of lug attachment member 120 may be tapered inward moving from its back edge toward the lug body 110. This creates a dovetailed design for the lug attachment member 120. The upper edge 121 of the lug attachment member 120 may be rounded as shown in FIGS. 4A and 4C. This lug attachment member 120 may be slid into a corresponding groove in the drum shell.

It is important to note that the particular shape of the lug body 110 is not important. Rather, it is only necessary that the tension rod 40 pass through a conduit in the lug body 110. Thus, the lug body 110 may be round, oval, rectangular, triangular, or any other desired shape.

Figure 5A:
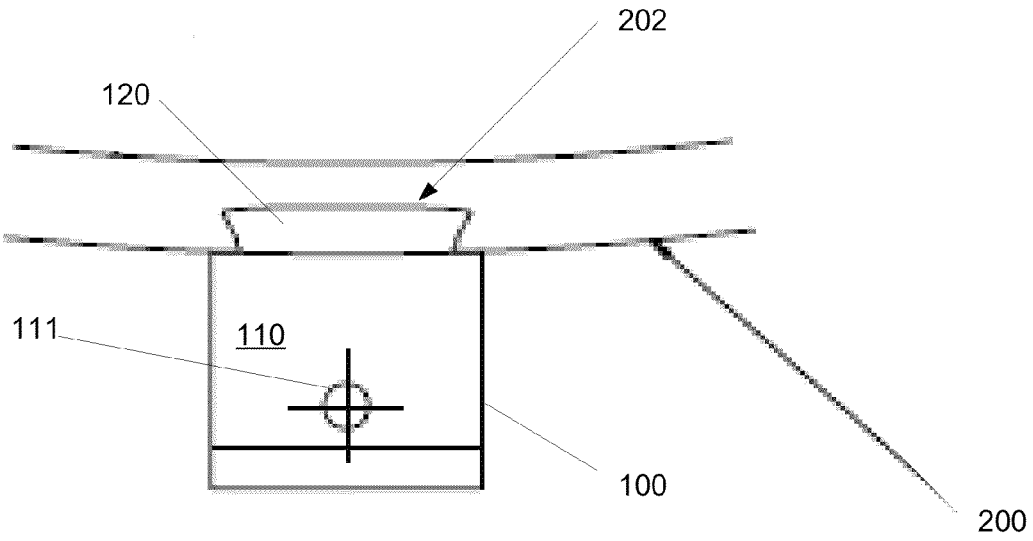
FIG. 5A shows a top view of the drum lug of FIG. 4A engaged with a drum shell.

FIG. 5A shows a top view of the lug 100 affixed to a drum shell 200. The drum shell 200 must be of sufficient thickness and strength such that a receiving slot or groove 202 may be cut into the shell. In some embodiments, this groove 202 is an undercut dovetail. In other words, the sides of the groove are tapered such that the sides are narrower at the surface of the drum shell than they are at the bottom of the groove. Unlike the bolts of the prior art, the receiving slot or groove 202 does not extend through the shell. In some embodiments, the drum shell is constructed of wood. Depending on the size and shape of the lug body 110, the back side of the lug body may be designed to conform to the arc swept by the drum shell 200. In other embodiments, the width of the lug body 110 is sufficiently small so that the back side of the lug body 110 may be straight.

Figure 5B:
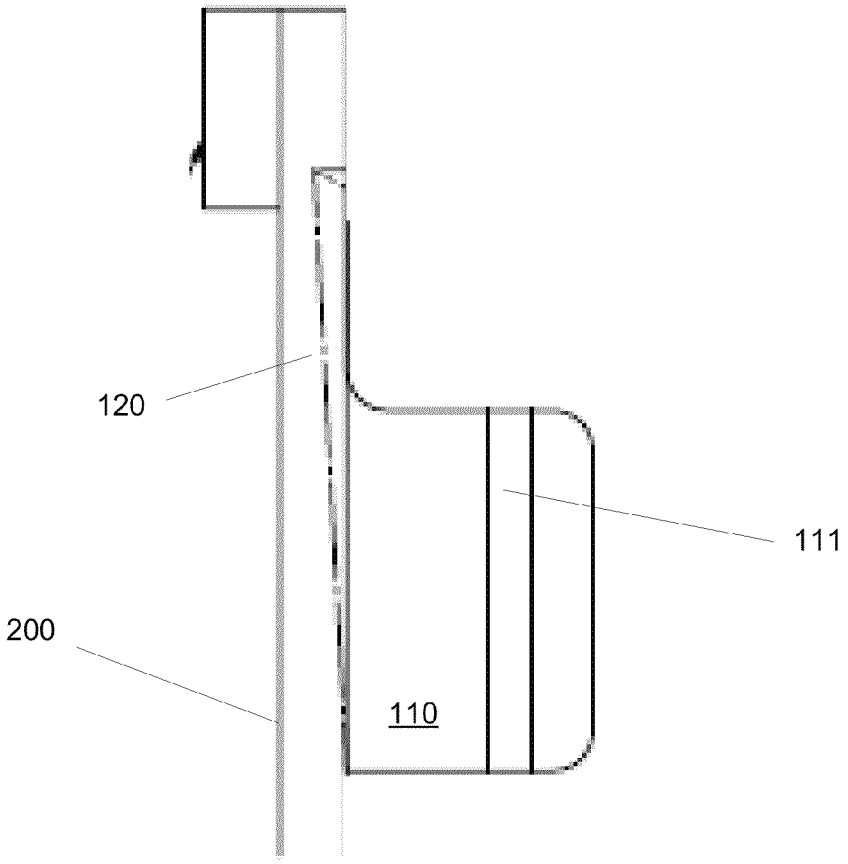
FIG. 5B shows a side view of the drum lug of FIG. 4A engaged with a drum shell.

In the embodiment shown in FIG. 5B, the lug attachment member 120 can then be slid upward into the receiving slot or groove 202. A tension rod can then be passed through the conduit 111 in the lug body 110. In some embodiments, the tension rod and the interior walls of the conduit 111 are both threaded so that the tension rod serves to hold the lug 100 in place.

The lug 100 and the shell 200 may be attached in other ways. For example, the receiving slot or groove 202 may be designed so that the lug in slid downward into the groove. It is only important that the lug has a method of attaching to the drum shell such that outward radial movement does not disengage the lug 100 from the shell 200. For example, as shown in the FIG. 5A, a dovetail groove may be used, in which the opening of the groove 202 (at the outer surface of the shell 200) is smaller than an internal portion of the groove 202. This allows the opening to hold the lug attachment member 120 in place, and prevent outward radial movement.

Figure 6C:
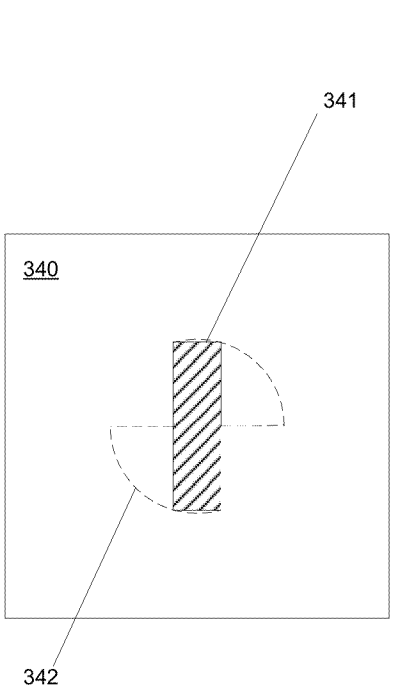
FIG. 6C shows the drum shell with a slot to accommodate the drum lug of FIG. 6A.
Figure 6B:
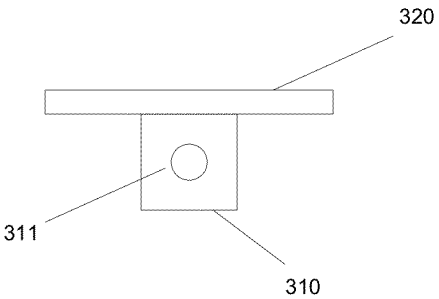
FIG. 6B shows a top view of the drum lug of FIG. 6A.
Figure 6A:
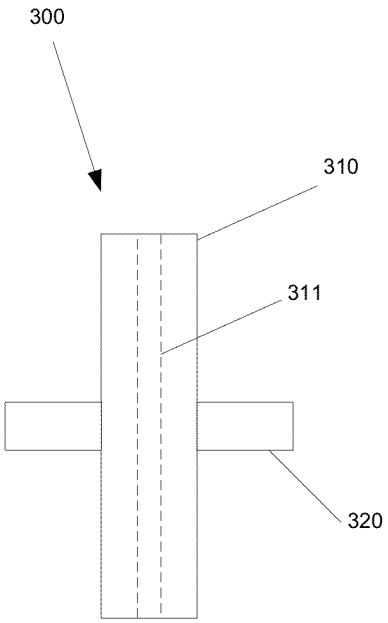
FIG. 6A shows a front view of a second embodiment of a drum lug.

FIG. 6A shows a front view of a second embodiment of a drum lug. In this embodiment, the drum lug 300 has a body 310, having a conduit 311 through it. In addition, one or more outwardly extending tabs 320 are attached to the rear side of the body 310. In some embodiments, the drum lug body 310 and tabs 320 are a unitary piece, while in other embodiments, they are affixed to one another. FIG. 6B shows a top view of drum lug 300, with the outwardly extending tabs 320 located in the rear of the body 310. FIG. 6C shows a drum shell 340, having a receiving slot 341 into which the tabs 320 are inserted. Two quarter circular grooves 342 (shown in dotted lines) is cut in the shell such that, after insertion, the tabs 320 and drum lug 300 can be rotated 90°, thereby locking the drum lug 300 in place.

Figure 7A:
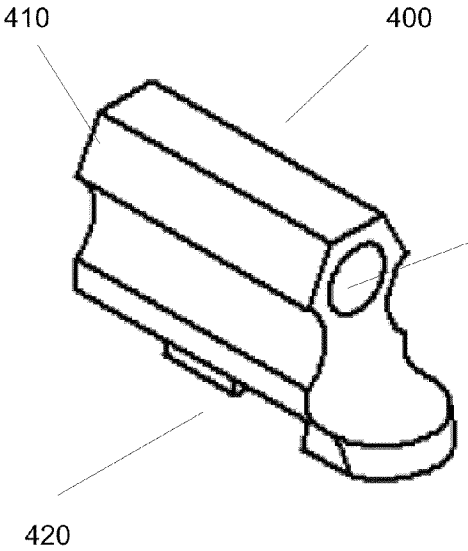
FIG. 7A shows a perspective view of a third embodiment of a drum lug.
Figure 7B:
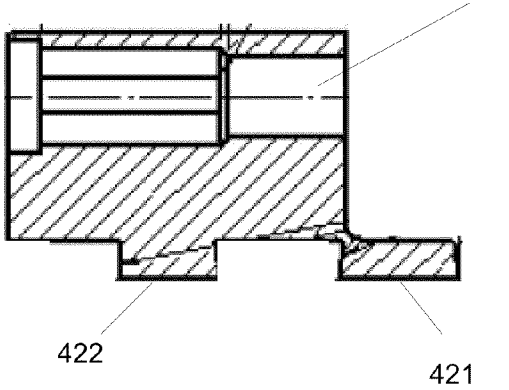
FIG. 7B shows a cross sectional view of the drum lug of FIG. 7A.

FIGS. 7A-B show another embodiment of a drum lug 400. In this embodiment, the lug 400 comprises a lug body 410 and a lug attachment member 420. A conduit 430 passes through the lug body 410. In FIG. 7B, the conduit is shown as having multiple diameters. This may be employed if the tension rod terminates at this lug body 410. In other embodiments, the conduit 430 may have a single diameter. Furthermore, in some embodiments, the conduit may be threaded.

In this embodiment, the top portion of the lug body 410 has a semi-hexagonal shape. However, this is not a requirement, and any suitable shape may also be used. In contrast to the embodiment of FIGS. 4A-4D, the bottom of the lug attachment member 420 is flat, rather than tapered.

The lug attachment member 420 is comprised of at least two parts; a rounded front end 421 and a smaller middle portion 422 separated from the rounded front end 421 by a first distance. This first distance is preferably at least as large as the length of the middle portion 422, as described in more detail below. Additional middle portions 422 may also be employed. The rounded front end 421 extends forward beyond the lug body 410. In one embodiment, the rounded front end 421 is beveled along its sides and front. The bevel is such that the rounded front end 421 is wider at its bottom than at its connection to the lug body 410. In another embodiment, the rounded front end 421 is not beveled.

The smaller middle portion 422 has the same height as the rounded front end 421. In one embodiment, the sides of the middle portion are beveled, as described above.

Figure 8:
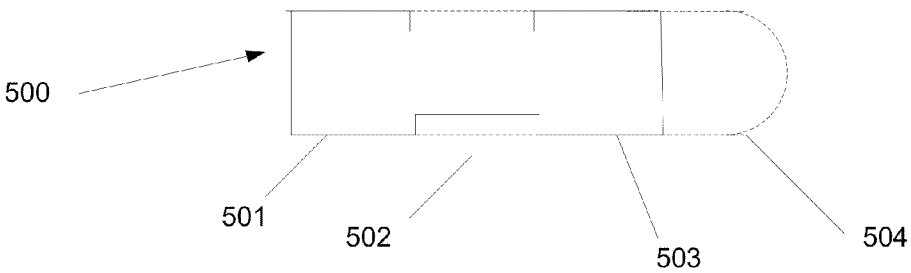
FIG. 8 shows a receiving slot for the lug of FIG. 7A-7B.

FIG. 8 shows a receiving slot 500 disposed on the drum shell to accept the lug attachment member 420. The receiving slot has a first straight walled portion 501, a tapered portion 502, a second straight walled portion 503 and a hidden slot portion 504.

First straight walled portion 501 may be sized to correspond to middle portion 422, such that middle portion 422 fits within first walled portion 501. Similarly, second straight walled portion 503 may be sized to accommodate the rounded front end 421. The tapered portion 502 is sized to accommodate the middle portion 422. Thus, the length of the tapered portion 502, which is equal to the first distance defined above, may be the same or greater than the length of the middle portion 422. The width of tapered portion 502 at the surface of the drum shell equals the width of the middle portion at its narrowest width. The width of the tapered portion 502 at its lowest depth equals the width of the middle portion at its widest point, and preferably equals the width of the first straight walled portion 501. Similarly, the hidden slot portion 504 is sized to accommodate the rounded front end 421.

In operation, the lug 400 is placed in the receiving slot 500. This is achieved by aligning the middle portion 422 with the first straight walled portion 501 and the rounded front end 421 with the second straight walled portion 503. The lug 400 is then pushed forward, such that the rounded front end 421 is disposed in the hidden slot portion 504 and the middle portion 421 is disposed in the tapered portion 502.

It is noted that, in another embodiment, the rounded front end 421 does not extend beyond the lug body 410. For example, the lug attachment member 420 may comprises a plurality of middle portions, spaced apart, which enter a receiving slot that comprises a plurality of straight walled portions and tapered portions.

In another embodiment, the drum lug may be glued to the shell using any suitable adhesive or glue. Importantly, the drum lug assembly is attached to the drum shell without the use of a fastener that passes through the drum shell, as is done in the prior art.

While the above description applied to wooden drum shells, the invention is not limited to this embodiment. In other embodiments, a drum lug may be bonded to a metal drum shell without penetrating the drum shell. For example, the drum lug may be attached via welding, brazing, gluing, or other techniques.

Figure 1:
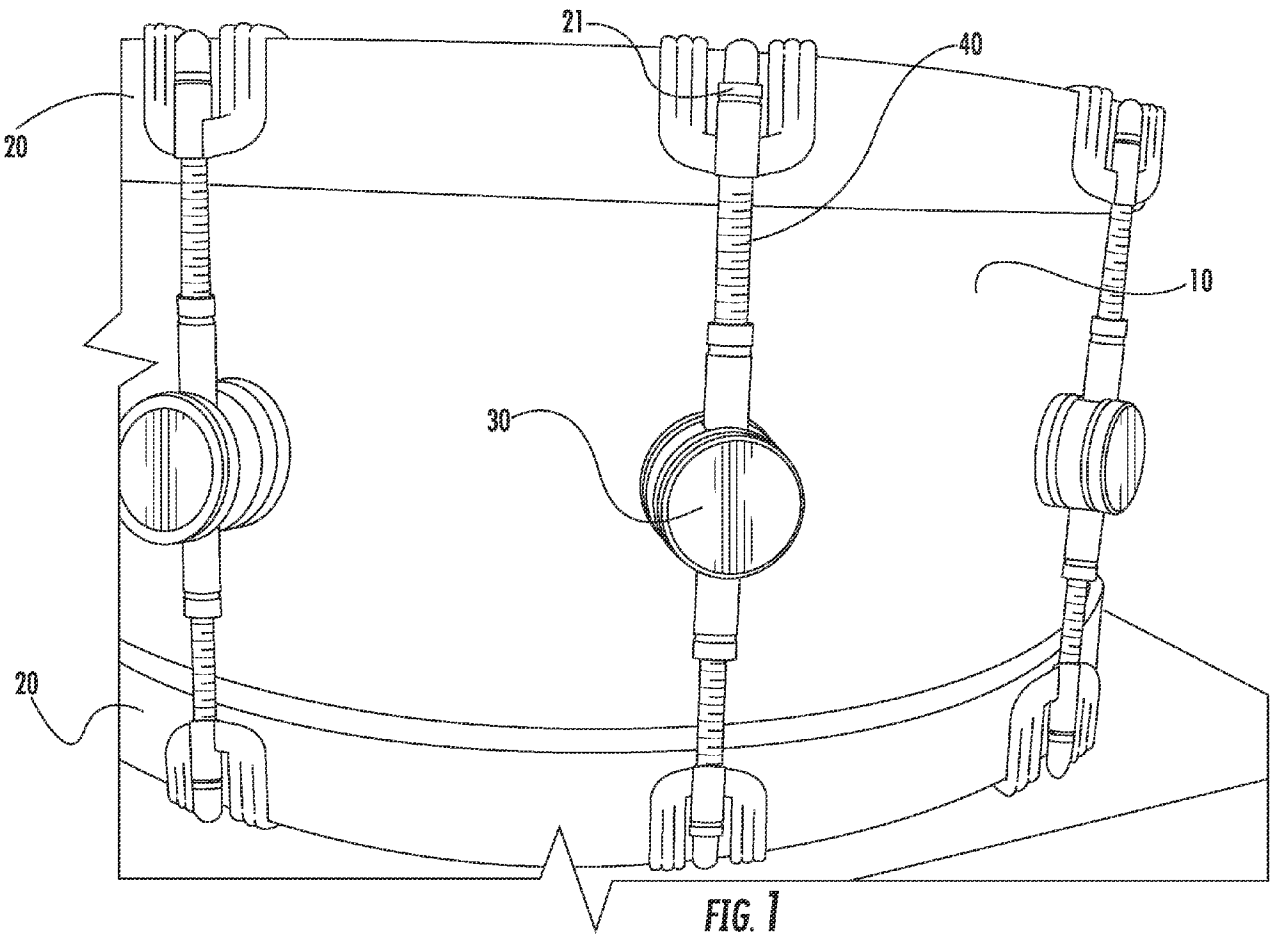
FIG. 1 (PRIOR ART)
FIG. 1 is a representative drum of the prior art.
Figure 2:
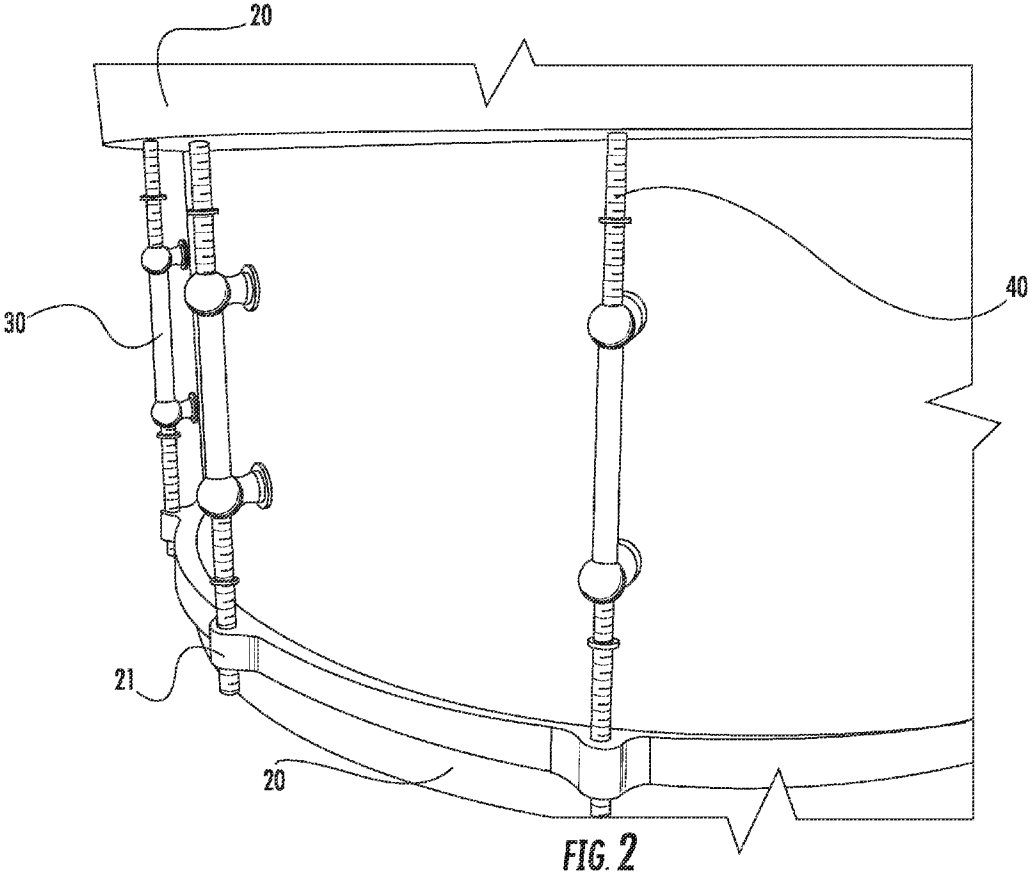
FIG. 2 (PRIOR ART)
FIG. 2 is a second representative drum of the prior art.
Figure 3:
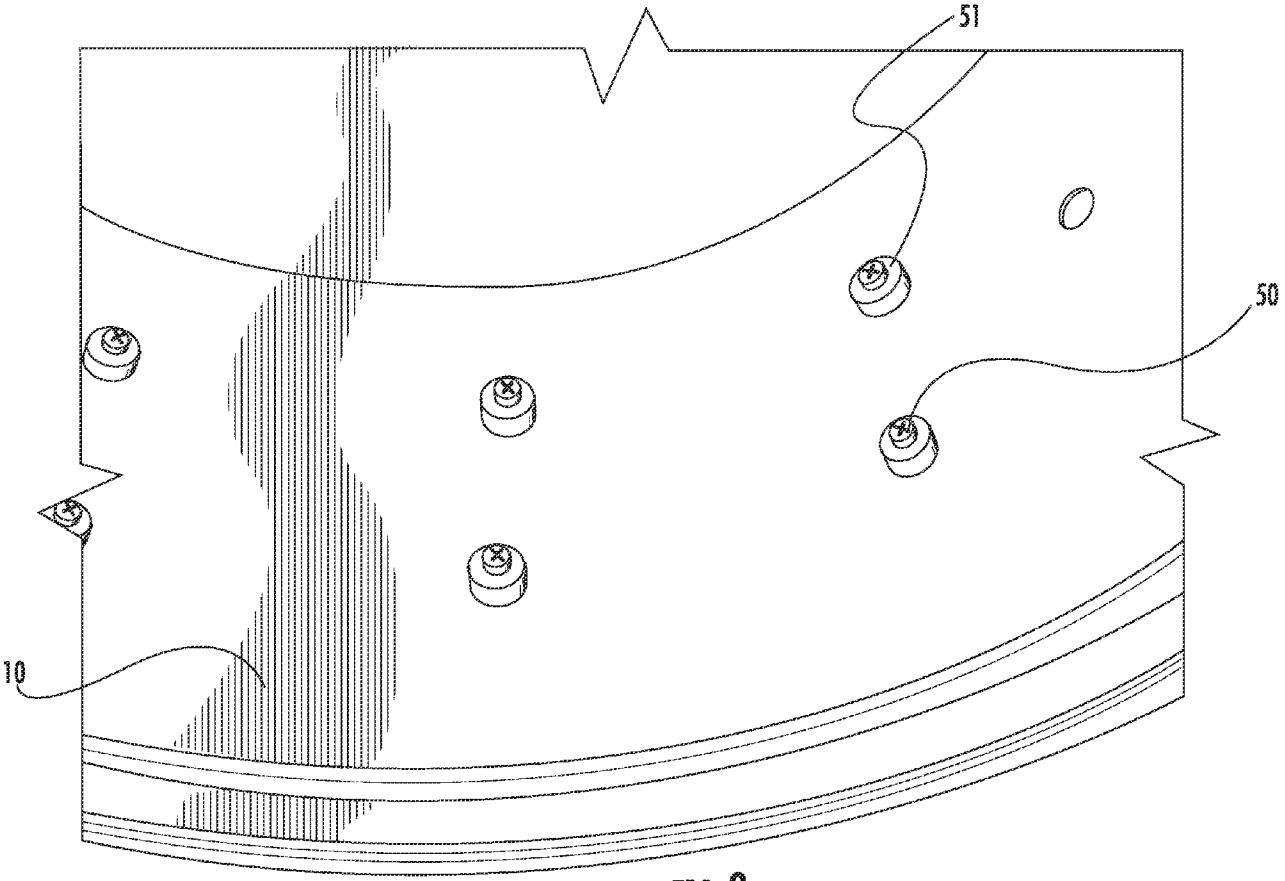
FIG. 3 (PRIOR ART)
FIG. 3 is an interior view of the drum of FIG. 2.

Furthermore, in some embodiments, a single drum lug is used to secure both drum heads, such that tension rods from both drum heads are attached to the drum lug (such as is shown in FIG. 1). In other embodiments, separate drum lugs are used for the top head and the bottom head (as shown in FIG. 2). The present invention may be used in either of these scenarios.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Further, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A drum, comprising:

a drum shell, comprising a receiving slot, wherein said receiving slot comprises a downward groove having undercut dovetailed walls, that are narrower at a surface of said drum shell than at a bottom of said receiving slot;

a drum head covering an end of said drum shell;

a drum lug assembly, attached to said drum shell, said drum lug assembly comprising a drum lug body having a conduit, and a lug attachment member, adapted to be attached to said drum shell without the use of a screw passing through said drum shell; and a rod joining said drum head and passing through said conduit in said drum lug assembly.

2. The drum of claim 1, wherein said lug attachment member comprises dovetailed sides configured to slid into said downward groove.

3. A drum, comprising:

a drum shell, comprising a receiving slot, wherein said receiving slot comprises two quarter circular grooves;

a drum head covering an end of said drum shell;

a drum lug assembly, attached to said drum shell, said drum lug assembly comprising a drum lug body having a conduit, and a lug attachment member, adapted to be attached to said drum shell without the use of a screw passing through said drum shell, wherein said lug attachment member comprises two outwardly extending tabs; and a rod joining said drum head and passing through said conduit in said drum lug assembly.

4. A drum, comprising:

a drum shell, comprising a receiving slot, wherein said receiving slot comprises a straight walled portion and a tapered wall portion;

a drum head covering an end of said drum shell;

a drum lug assembly, attached to said drum shell, said drum lug assembly comprising a drum lug body having a conduit, and a lug attachment member, adapted to be attached to said drum shell without the use of a screw passing through said drum shell; and a rod joining said drum head and passing through said conduit in said drum lug assembly.

5. The drum of claim 4, wherein said lug attachment comprising a middle portion having dovetailed sides, whereby the sides are wider at a bottom than at the point said sides attach to said lug body.

6. The drum of claim 5, wherein a width of said straight walled portion is equal to a width of said middle portion at its greatest width.

7. The drum of claim 5, wherein a width of said tapered portion at a surface of said drum shell is equal to a width of said middle portion at the point said middle portion attaches to said lug body.

8. The drum of claim 5, wherein a width of said tapered portion at its lowest depth is equal to a width of said middle portion at its widest point.

* * * * *